United States Patent [19]

Boehme et al.

[11] 4,214,387

[45] Jul. 29, 1980

[54] TRENCHING APPARATUS AND METHOD

[75] Inventors: Herman F. Boehme; Avadhesh N. L. Srivastav; Joe C. Lochridge, all of Houston, Tex.

[73] Assignee: Brown & Root, Inc., Houston, Tex.

[21] Appl. No.: 911,370

[22] Filed: Jun. 1, 1978

[51] Int. Cl.[2] ..... B02F 3/88

[52] U.S. Cl. ..... 37/195; 37/64; 37/65

[58] Field of Search ..... 37/56, 58, 61–64, 37/65–67, 72–73, 94, 102, 195; 405/159, 161–164

[56] References Cited

U.S. PATENT DOCUMENTS

| | | | |
|---|---|---|---|
| 3,103,790 | 9/1963 | Popich | 405/162 |
| 3,429,131 | 2/1969 | Martin | 37/65 X |
| 3,429,132 | 2/1969 | Martin | 405/161 |
| 3,434,297 | 3/1969 | Gretter et al. | 405/160 |
| 3,583,170 | 6/1971 | De Vries | 405/162 |
| 3,670,514 | 6/1972 | Breston et al. | 37/102 X |
| 3,683,521 | 8/1972 | Sloan et al. | 37/67 X |
| 3,717,003 | 2/1973 | Bates, Jr. et al. | 37/63 X |
| 3,732,700 | 5/1973 | Lynch | 37/61 X |
| 3,732,701 | 5/1973 | Lynch | 37/65 X |
| 3,751,927 | 8/1973 | Perot, Jr. | 37/63 X |
| 3,786,642 | 1/1974 | Good et al. | 37/62 X |
| 3,791,156 | 2/1974 | Van Zutphen | 72/32 X |
| 3,852,972 | 12/1974 | Holberg | 37/62 |
| 3,857,250 | 12/1974 | DiTella et al. | 37/62 X |
| 3,857,651 | 12/1974 | Bruno | 37/65 X |
| 3,893,404 | 7/1975 | Chandler et al. | 115/7 |
| 3,893,531 | 7/1975 | Gee | 37/54 X |
| 3,978,679 | 9/1976 | Lecomte | 37/58 X |
| 4,022,028 | 5/1977 | Martin | 37/63 X |
| 4,037,422 | 7/1977 | Deboer et al. | 405/164 X |

FOREIGN PATENT DOCUMENTS

| | | | |
|---|---|---|---|
| 2411140 | 11/1975 | Fed. Rep. of Germany | 405/163 |
| 1399802 | 7/1975 | United Kingdom | 37/65 |

*Primary Examiner*—E. H. Eickholt

*Attorney, Agent, or Firm*—Kenway & Jenney

[57] ABSTRACT

An apparatus and method for trenching beneath an elongated member lying on the bottom of a body of water are disclosed. The apparatus has a movable frame member, at least one cutting assembly, an assembly support means connected to the frame member for supporting each cutting assembly and for moving each cutting assembly at least in a laterally directed plane, and a spoil removal system. Each cutting assembly comprises at least two actuatable cutting tools which are driven for cutting movement relative to cutting tool axes. The cutting tool axes, for each cutting assembly, define an assembly cutting plane and means are provided for rotating the assembly cutting plane relative to the laterally directed plane, thereby, varying the cutting swath of the associated cutting assembly. In one aspect the method of the invention is directed to trenching from both sides of and beneath the elongated member to be buried. In another aspect, the method is directed to trenching from one side only, or from one side of and then from the other side of and beneath the elongated member to be buried.

26 Claims, 10 Drawing Figures

TRENCHING APPARATUS AND METHOD

The invention relates to apparatus and methods for use in underwater environments and more particularly, to apparatus and methods for burying or entrenching an elongated member lying on the bottom of a body of water.

BACKGROUND OF THE INVENTION

It is common, after placing a pipeline, a submarine cable, or other elongated member, at the bottom of a body of water, to bury or entrench the elongated member to avoid the effects of, for example, ocean or other water currents, passing vessels, and other hazards of the sea. Various techniques for entrenching an elongated member have been suggested and used. By far the most common is the "jetting" method by which fluids are propelled at high velocities against the subsea surface to dislodge and otherwise remove debris and other ground materials from beneath the elongated member, so that the member will fall into the resulting trench and thereby be safely situated beneath the water bottom.

Despite its versatility, as compared to other methods of trenching thus far used, the "jetting" method nevertheless has its shortcomings. For example, the jetting method has a high operating cost and a slow rate of progress, is uneconomical for deeper waters, and is relatively inefficient in certain kinds of soil composition.

As the demand for oil and gas resources has increased, those exploring offshore for these natural resources have ventured into deeper waters and more severe environments. In order to extend the trenching capability to these deeper waters, considerable effort has been devoted to the development of other trenching techniques. As a result, equipment utilizing mechanical cutters has been discussed in the literature, and various versions of such equipment have been developed, all using the same basic trenching technique. They differ from each other primarily only in certain relatively minor details. Generally, these devices are also relatively inflexible and cannot easily be adapted to different trenching applications.

It is therefore an object of the invention to provide an apparatus and method for trenching the bottom of a body of water which operates at depths up to and exceeding 3000 feet, which has a relatively low operating cost, and which has a relatively high rate of progress.

Further objects of this invention are to provide a novel cutting assembly which is capable of varying the width of the cutting swath, which flexibly varies the depth and angle of the cutting assembly, and which provides mechanical cutting means to trench from a side to a position beneath an elongated member.

Other objects of the invention include providing a trenching apparatus which can be operated by either remote control or by an operator on board the apparatus, which provides reliable and safe access to the operating control module or chamber, and which is particularly useful for trenching beneath a prelaid pipeline.

SUMMARY OF THE INVENTION

An apparatus for trenching beneath an elongated member lying on the bottom of a body of water, according to the invention, features a movable frame member for movement relative to the elongated member, at least one cutting assembly, assembly support means connected to the frame member for supporting each cutting assembly and for moving each cutting assembly at least in a laterally directed plane substantially normal to a longitudinal axis of the frame member, and spoil removal means supported in a proximate relation to each cutting assembly, for removing spoil or debris produced by the operation of each cutting assembly. Each cutting assembly comprises at least two actuatable cutting tools, tool support means for supporting each of the cutting tools in a downwardly extending direction for cutting movement about their respective tool axes, the tool support means being connected to and movable by the assembly support means, and means for rotating the tool support means and an assembly cutting plane about an assembly longitudinal axis for varying the cutting width of the cutting assembly, the assembly axis being substantially parallel to both the assembly cutting plane and the laterally directed plane. Each actuatable cutting tool has a mechanical cutting means secured thereto for cutting movement, and drive means actuatable for driving, relative to a cutting tool axis, the cutting means in the direction of cutting movement. The cutting tool axes for each assembly are substantially aligned in and define the assembly cutting plane.

In one aspect of the apparatus of the invention, two cutting assemblies are provided, a first forward cutting assembly and a second rearward cutting assembly, the assemblies having, respectively, first and second laterally directed planes, the planes being spaced apart along the longitudinal axis of the frame. Thus, the assemblies are offset mounted on the frame member in a spaced apart relationship both laterally and longitudinally with respect to the center of frame member.

According to a preferred embodiment of the invention, each cutting assembly is supported by a cutting depth control assembly which is part of the assembly support means and which varies the position of the associated cutting assembly along the cutting assembly longitudinal axis. The assembly support means also includes a cutting angle control assembly for varying the angular orientation of the longitudinal axis of an associated cutting assembly in the laterally directed plane.

In another aspect of the invention, the trenching apparatus further features a pressure stabilized control chamber, secured to the frame member, for housing an operator to control operation of the apparatus. The chamber includes a transfer module connection for releasably coupling to a transfer module for effecting movement of personnel between the chamber and the module.

In a particularly preferred embodiment of the invention, the cutting tools are rotatable. Each cutting tool has a mechanical cutting means secured thereto for rotational movement and a drive means actuatable for rotating the mechanical cutting means relative to a cutting tool rotation axis. Preferably adjacent cutting tools of each assembly rotate in opposite directions about their respective tool rotating axes.

According to the method of the invention for trenching beneath an elongated member lying on the bottom of a body of water, there are featured the steps of trenching from one side of and to a position extending beneath the elongated member and removing the spoil resulting therefrom to form a first trench; trenching from the other side of and to a position extending beneath the elongated member and removing the spoil created during the second trenching step to form a second trench; the second trench extending into the first trench, and performing the two trenching steps successively (either sequentially or simultaneously) so that the elongated member falls into the resulting first and second trenches.

The method further features the steps, in a particular embodiment, of providing for each of the trenching steps a pair of rotatable cutters mounted on a rotatable bifurcated support arm. In a particular aspect of the method, there is provided a trenching apparatus having cutting assemblies offset both longitudinally and laterally of the apparatus to successively and simultaneously trench beneath the elongated member.

DESCRIPTION OF THE DRAWINGS

Other objects, features, and advantages of the invention will appear from the following description of preferred particular embodiments taken together with the drawings in which.

DESCRIPTION OF PARTICULAR PREFERRED EMBODIMENTS

General Description

Figure 1:
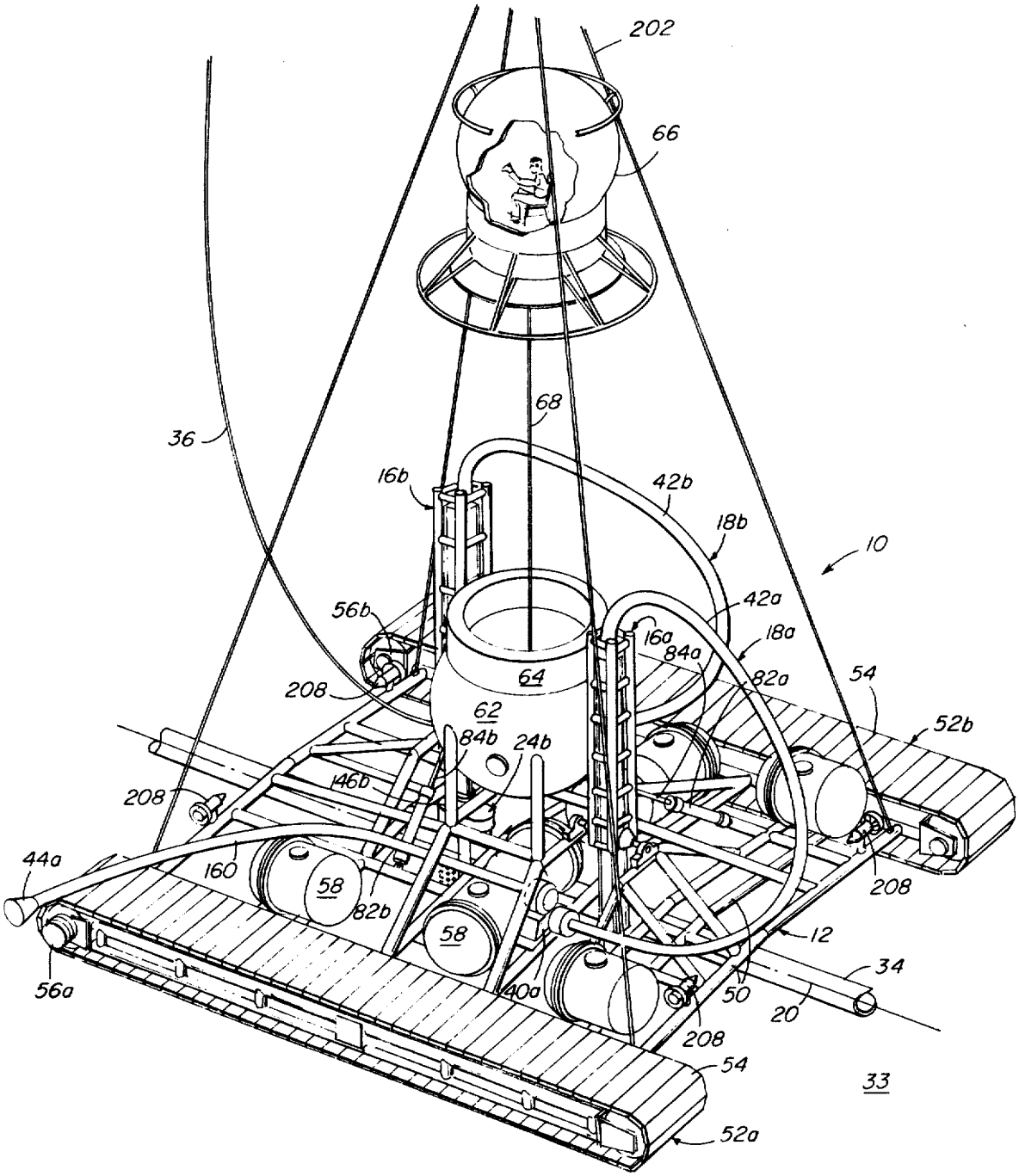
FIG. 1 is a top perspective view of an apparatus constructed according to the invention positioned on the bottom of a body of water.
Figure 2:
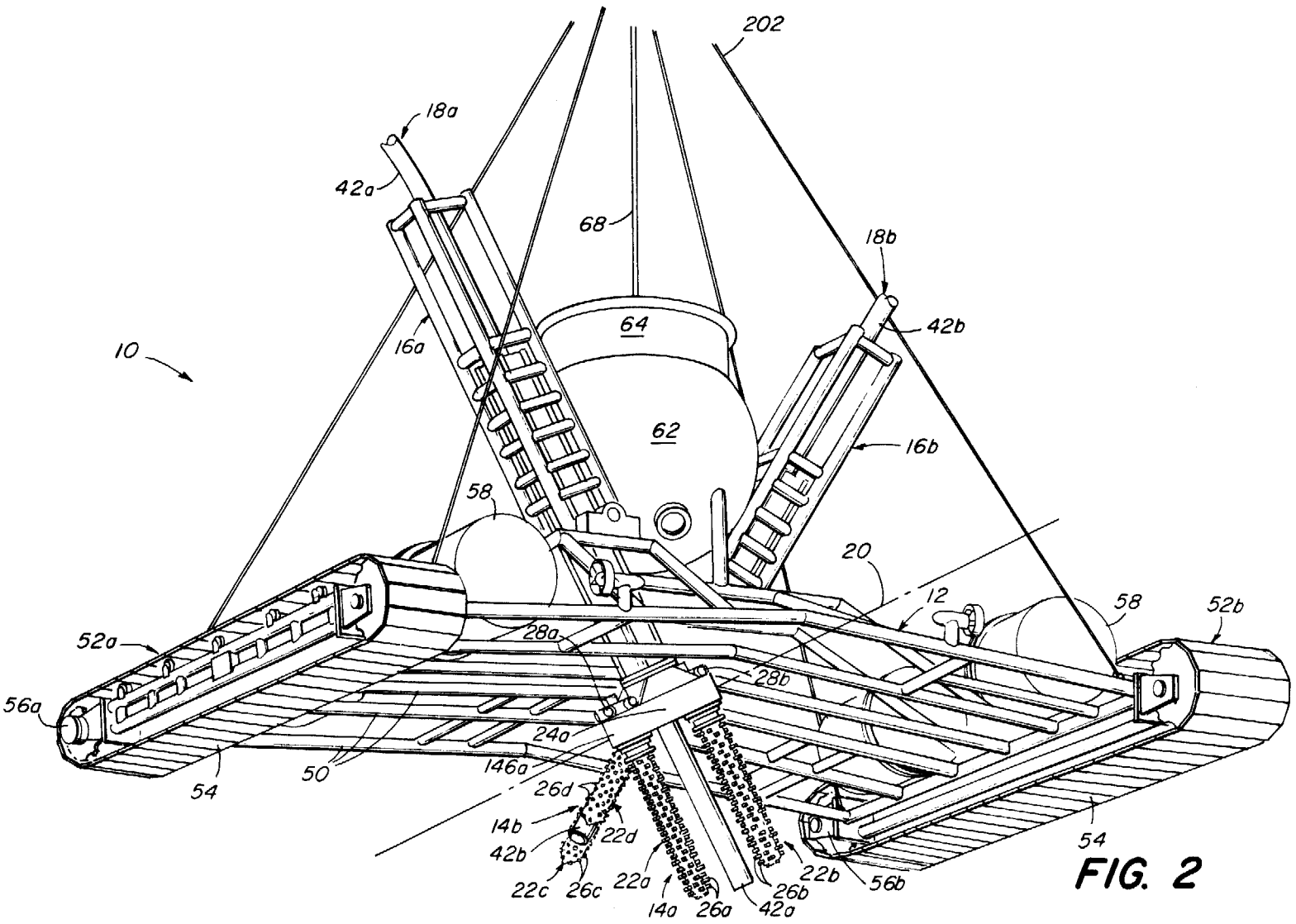
FIG. 2 is a bottom perspective view of an apparatus constructed according to the invention showing in particular the cutting assemblies and the frame member.

Referring to FIGS. 1 and 2, an apparatus 10 for trenching the bottom of a body of water has a movable frame member 12, at least one and preferably two cutting assemblies 14*a*, 14*b*, assembly support means 16*a*, 16*b*, and spoil removal means 18*a*, 18*b*. The assembly support means is connected to the frame member and supports each cutting assembly. The assembly support means also is connected to move each cutting assembly at least in a laterally directed plane substantially normal to a longitudinal axis 20 of the frame member.

Each cutting assembly, of which there are two in the illustrated embodiment, comprises at least two actuatable cutting tools 22*a*, 22*b* and 22*c*, 22*d* and tool support means 24*a*, 24*b*. Each cutting tool 22*a*, 22*b*, 22*c*, 22*d* has mechanical cutting means 26*a*, 26*b*, 26*c*, 26*d* secured thereto for a cutting movement, and drive means 28*a*, 28*b*, 28*c*, 28*d* actuatable for driving the cutting means, relative to cutting tool axes 30*a*, 30*b*, 30*c*, 30*d*, respectively, in the direction of cutting movement. The cutting tool axes 30*a*, 30*b* and 30*c*, 30*d*, corresponding to the cutting tools of each cutting assembly, are substantially aligned in and define a cutting assembly cutting plane.

The cutting tools are supported by the tool support means 24*a*, 24*b* in a generally downwardly extending direction for cutting movement relative to their respective cutting tool axes 30. The tool support means 24*a*, 24*b* are connected to and movable by the assembly support means 16*a*, 16*b* respectively. Each tool support means can also be rotated about an assembly longitudinal axis 32*a*, 32*b* for varying the width of the cutting swath of the cutting assembly. Each assembly longitudinal axis is substantially parallel to both the associated assembly cutting plane and the associated laterally directed plane of the frame member, and the assembly cutting plane is rotated about the assembly longitudinal axis as the associated tool support means is rotated about that axis.

Figure 10:
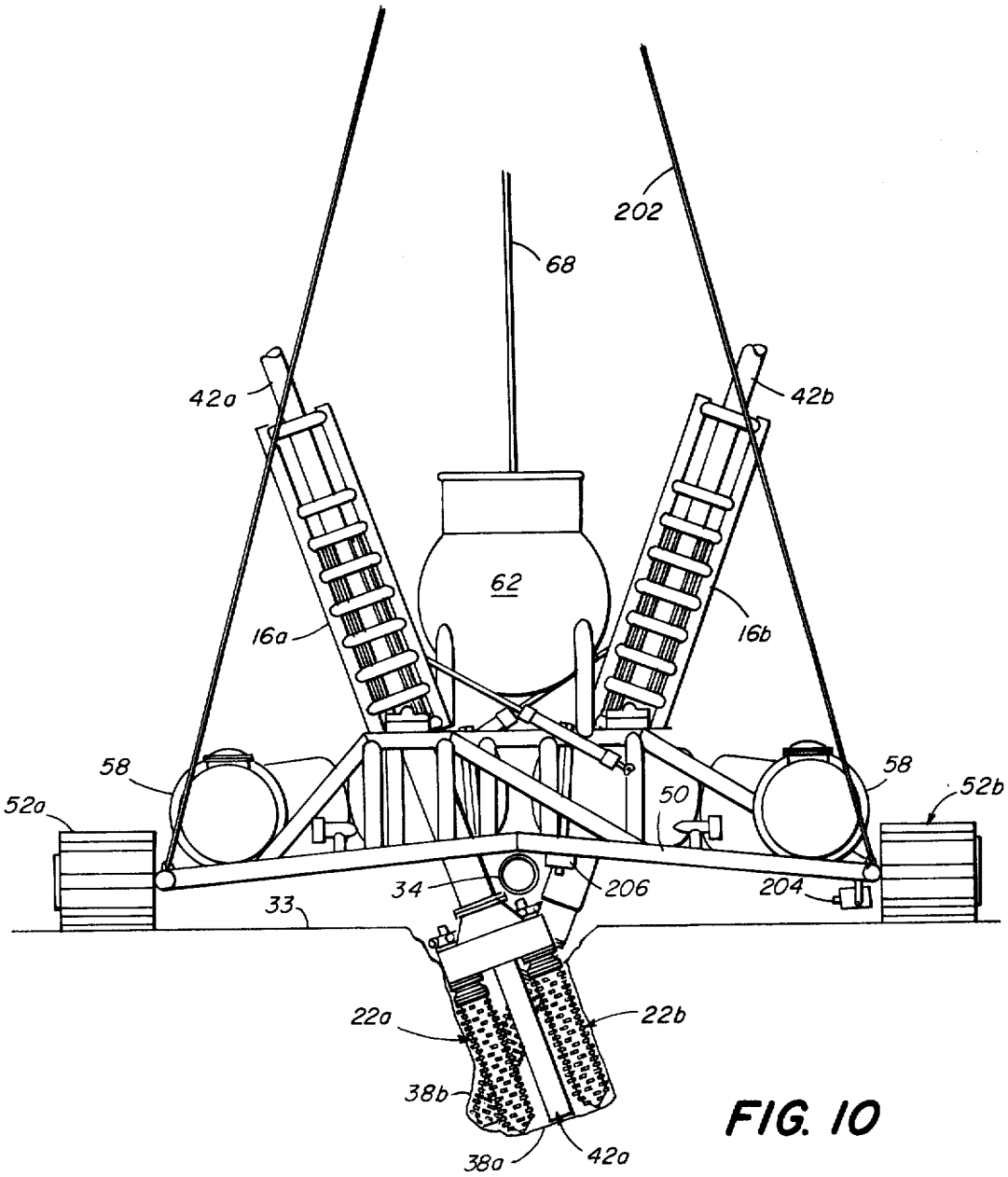
FIG. 10 is a simplified cross-section of the apparatus of FIGS. 1–7 in operation.

The trenching apparatus 10 is lowered from a surface vessel (not shown) into an operational relationship to an enlongated member, for example a pipeline 34 lying on the bottom 33 of a body of water. The apparatus may thereafter be either pulled along by a surface vessel or may be self-propelled employing fluid and/or electrical power provided over a power umbilical 36 from a surface vessel. (The hydraulic and electrical interconnections have been omitted in the figures to provide clearer views of the apparatus.) Prior to moving the apparatus forward, the cutting assemblies 14, which in the illustrated embodiment are both longitudinally and laterally offset from the center of the trenching apparatus and its frame, are moved to a position whereby they successively and simultaneously trench beneath the elongated member and preferably wherein the resulting trenches 38*a*, 38*b* overlap to provide a single trench into which the elongated member 34 falls (FIG. 10). The spoil and debris generated as a result of the trenching step is removed by the spoil removal means 18 which, in this particular embodiment, employs a suction creating source such as frame mounted centerless pumps 40*a*, 40*b*, which create a suction at the bottom end of the respective eductor cylindrical tubular members 42*a*, 42*b*. This suction causes the spoil to be drawn into the tubular members and discharged in a direction away from the apparatus 10 at eductor discharge openings 44*a*, 44*b*.

The Frame Member

Frame member 12 comprises a plurality of tubular structural members 50 interconnected, for example, by welding, to provide a rigid structural support for the assembly support means, the spoil removal means, the cutting assemblies, and other associated equipment (to be described below) required to properly operate the trenching apparatus. The tubular members 50 may be interconnected to form a fluid-tight buoyancy control system for controlling, in part, the buoyancy of the frame 12. In the illustrated embodiment, the frame member 12 supports a pair of crawler members 52*a*, 52*b*, one on each side of the frame. In other embodiments, more than one crawler member may be provided on each side of the frame. Each crawler consists of an endless chain of linked tracks 54 and each crawler is powered or driven by a separate hydraulic power drive unit 56*a*, 56*b*. While the apparatus can have many different effective operating configurations, in the illustrated embodiments, the trenching apparatus 10 is self-propelled having hydraulic motors 56 driving the caterpillar type crawlers 52 in a forward or reverse direction. In other embodiments of the invention, the crawlers may be replaced by, for example pontoons, whereby the apparatus would be pulled for example by a surface vessel through a tow line connected between the vessel and the trenching apparatus.

The frame member further supports a plurality of pressure stabilized tanks 58 for housing the electro-hydraulic power and control elements which provide the drive power to (a) propel the apparatus, (b) operate the assembly support means, (c) drive the cutting assemblies, (d) operate the spoil removal system, and (e) provide power to other auxiliaries. Tanks 58 can also vary the buoyancy of the apparatus. Power umbilical 36 carries electrical power and acoustic signals to operate the electrical monitoring and control systems on the trenching apparatus as described below. An umbilical tower (not shown) can be provided to keep the umbilical 36 away from other components of the apparatus.

The illustrated frame member further supports a pressure stabilized control chamber 62 in which an operator may be safely housed to control all operations of the apparatus. The apparatus may also be controlled remotely by duplicating all of the controls on a surface vessel and connecting the surface vessel to the apparatus through umbilical 36. Although other chamber configurations can be used, the illustrated control chamber has a substantially spherically shaped outer shell which is able to withstand the hydrostatic pressures at 3000 or more feet. The outer shell of the control chamber has a cylindrical portion 64 at its upper end; and cylindrical portion 64 is designed to releasably couple, in a standard manner, with a corresponding portion of a transfer module 66 which enables personnel to transfer between the control chamber 62 and a surface vessel (not shown). The transfer module 66 and the control chamber 62 are preferably connected by a guide line 68 which is used to "winch down" or "winch up" the transfer module 66 to and from the control chamber 62. The winch, not shown, is provided on frame 12. Pressure stabilized control chamber 62, as well as the transfer module, are each maintained at substantially one atmosphere pressure to provide a suitable environment for the control operator.

The Cutting Assembly Support Means

The two cutting assembly support means **16*a*, 16*b* of the illustrated embodiment operate in an identical manner and are of identical construction. Therefore, only support means 16*a* will be described in detail. However, corresponding parts of the two illustrated support means 16** are labelled with corresponding reference numbers (differing in the letter suffix).

The cutting assembly support means, in the preferred embodiment, is supported by frame member 12 for pivotal movement about a pivot axis 76 (FIGS. 3 and 4) extending parallel to the longitudinal axis of the frame member. The cutting assembly support means is supported by the frame member at bearing support members 78,80 on each side of the support means, which allow the pivoting movement of the assembly support means 16, and hence the cutting assembly 14, in the laterally directed plane substantially normal to the longitudinal axis of the frame member. The degree of pivotal movement is controlled by a cutting angle control assembly, here a linear actuator, such as a hydraulically operated cylinder 82, having an extending rod 84 which is connected between tubular structural members 50 and a longitudinally stationary portion of the assembly support means 16. The connections of the rod and actuator assembly to the frame member and support means each provide for pivotal movement of the actuator rod in the laterally directed plane. That movement accommodates for the rotational movement of the rod to support assembly connection relative to the positionally fixed cylinder to frame connection.

Figure 5:
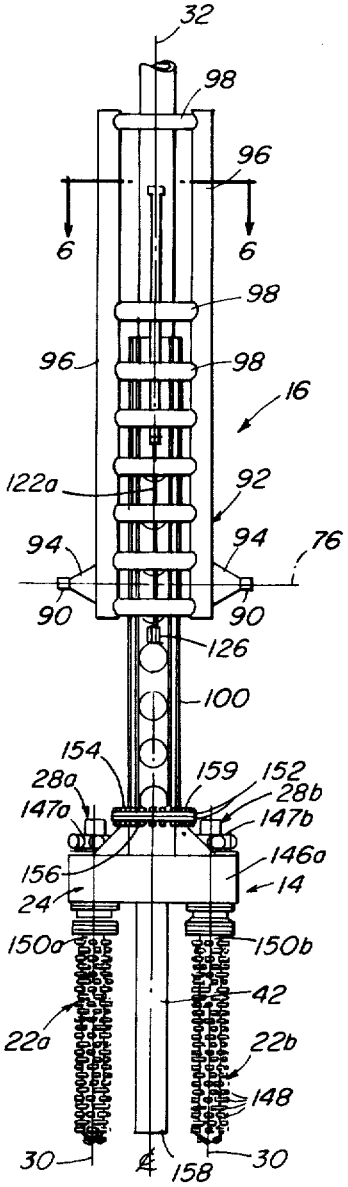
FIG. 5 is an elevation view detailing the cutting assembly and a portion of the means used to support the cutting assembly.
Figure 6:
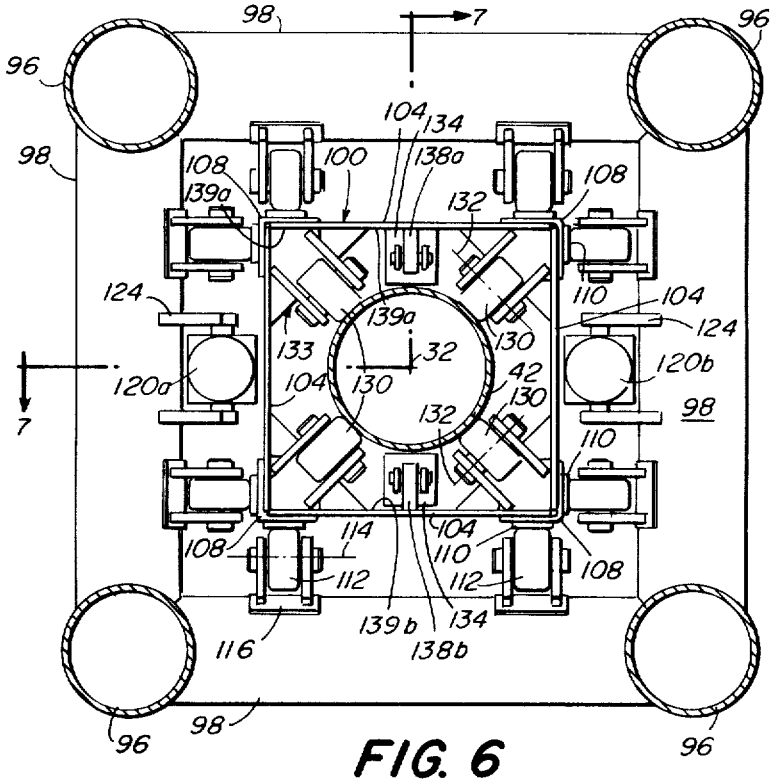
FIG. 6 is a cross-sectional view taken along lines 6—6 of FIG. 5.
Figure 7:
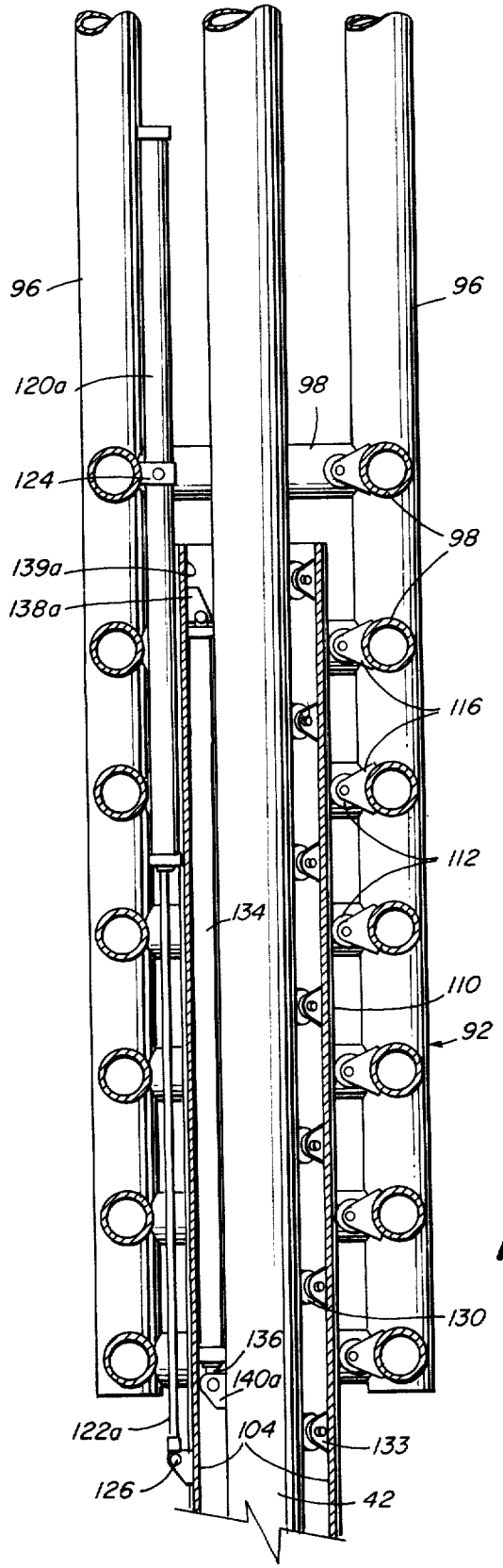
FIG. 7 is a cross-sectional view taken along lines 7—7 of FIG. 6 with some guide members omitted and with a portion of the spoil removal means rotated 90° for clarity.

Referring now to FIGS. 5, 6, and 7, the support means has cylindrical protrusions 90 connected to a support means main frame 92 by support members 94. Protrusions 90 are supported for movement in bearing support members 78, 80 connected to the frame member 12, as described above, the supporting structure allowing the support means to pivot around pivot axis 76. Support members 94 may, for example, be welded to structural tubular members 96, 98 of the support means. The primary support structure of illustrated support means 16, the main frame 92, has a plurality of vertically disposed tubular members 96 arranged in a substantially square cross-sectional configuration interconnected around the square periphery by substantially horizontally disposed short tubular members 98.

Arranged within the primary structure defined by tubular members 96, 98 is a cutting depth control assembly for varying the position of the associated cutting assembly along the assembly longitudinal axis. The illustrated assembly includes a telescoping cutting assembly support member 100, which is controllably translated in the direction of the assembly longitudinal axis 32 for moving the cutting assembly 14 parallel to longitudinal axis 32. (The illustrated cylindrical tubular member 42 is substantially coaxial with telescoping cutting assembly support member 100 and can be moved independently of support member 100 in a direction parallel to the longitudinal axis 32 of the cutting assembly.)

The telescoping cutting assembly support member, in the illustrated embodiment, has a plurality of flat, elongated structural members 104 assembled to form a telescoping hollow cylinder having a square cross section. The telescoping cylinder is reinforced at its corners by right-angled structural strip members 108 having secured thereto a plurality of flat strip guide members 110. A plurality of cam members, here rollers 112, are supported for rotational movement about roller axes 114. Rollers 112 contact the telescoping cutter assembly support member at the flat strip guide members 110 to provide guiding alignment to all sides of the telescoping cylinder. The rollers 112 are supported for rotation by roller support members 116 which are each secured, for example by welding, to horizontal tubular members 98.

The translational movement of telescoping cutting assembly support member 100 along assembly longitudinal axis 32 can be controlled by hydraulically actuated cylinders **120*a* and 120*b* having extending piston rods 122*a* and 122*b*, as illustrated, or alternatively, by for example, a rack and pinion type device (not shown). Cylinders 120 are secured in the illustrated embodiment to the tubular members 98 of the cutting assembly support means 16, for example by brackets 124 welded to the tubular members 98. Each piston rod 122 is connected to the telescoping support member 100, and in particular to the telescoping cylinder, at a pivotal connecting point 126. Thus, as the hydraulically controlled and actuated cylinders 120 vary the position of the piston rods 122, the telescoping support member 100** translates parallel to the longitudinal axis of the cutting assembly.

The cylindrical tubular member 42 is supported for telescoping movement within and is preferably coaxial with the support member 100. A plurality of camming members 130 are spaced around the outer periphery of tubular member 42. In the preferred embodiment, the camming members 130 are rollers mounted for rotational movement about respective rotation axes 132 and are supported by and secured to interior walls of the telescoping cylinder by roller support assemblies 133. The rollers 130 align and guide the tubular member 42 for telescoping movement parallel to the longitudinal axis 32 of the cutting assembly.

In the illustrated embodiment, the support member 100 and tubular member 42 are both supported coaxially with the longitudinal axis 32 of the cutting assembly. The tubular member is supported by hydraulically controlled cylinders 134 positioned 180° apart and each having a piston rod 136 for moving the cylinder 42. Cylinders 134 are each supported, in the illustrated embodiment, at their upper end by structural support means 138*a*, 138*b*, which may, for example, be welded to the interior walls 139*a*, 139*b* of the telescoping cylinder. Each cylinder 134 is vertically disposed and the piston rods, in the illustrated embodiment, extend from the lower end of the cylinders 134 and are connected to tubular member 42 by structural supports 140*a*, 140*b*. Thus, actuation of hydraulically controlled cylinders 134 causes the tubular member 42 to move with respect to the telescoping cylinder; however, the tubular member 42 will, for a fixed position of the cylinders 134 and rods 136, move or translate with the support member 100 under control of cylinders 120 and rods 122. Each movable component is additionally provided with locking devices and supports (not shown).

The Cutting Assemblies

Referring to FIGS. 2 and 5, each cutting assembly 14*a*, 14*b*, includes two cutting tools 22*a*, 22*b* and 22*c*, 22*d*. Each pair of tools 22 is mounted on a rotatable bifurcated support arm 146*a*, 146*b*. Each cutting tool is preferably independently rotated by hydraulic drive means 28*a*, 28*b*, as is well known in the art; the top housing 147*a*, 147*b*, of the drive means, e.g. motors, being visible above the arms 146. In the illustrated embodiment, adjacent cutting tools rotate in opposite directions but in other embodiments of the invention adjacent tools may rotate in the same or opposite direction.

Each cutting tool includes a mechanical cutting means secured thereto for cutting movement. In the illustrated embodiment, the cutting means are a plurality of replaceable cutting elements 148 mounted about the outside surface of supporting cylinders 150. The cutting elements are rotated about the respective cutting tool axes 30; and for each cutting assembly, the cutting tool axes associated with the cutting tools of that assembly define a cutting plane in which each associated cutting tool axis substantially lies. In other embodiments of the invention, the cutting means may be any other configuration used to provide mechanical cutting and may, for example, comprise a plurality of cutting elements which reciprocate in a direction parallel to the assembly longitudinal axis.

Continuing to refer to FIGS. 2 and 5, the bifurcated support arm 146 is connected to the telescoping cylinder through outwardly extending flange members 152 which are connected by bolts 154 and nuts 156. Prior to being lowered into the water, the cutting assembly can thus be rotated about the longitudinal cutting assembly axis by rotating flanges 152 relative to each other, whereby the effective cutting swath of the cutting assembly is varied. Thus, the width of the cut may be varied, in the illustrated embodiment on board the surface vessel, by varying the orientation of the assembly cutting plane relative to the assembly longitudinal axis 32. When the cutting plane is normal to the longitudinal axis of the frame, the cutting swath is greatest, and when the cutting plane is parallel to the longitudinal axis of the frame, the cutting swath is at a minimum. Between these two extremes, the cutting swath may be varied substantially at will depending only upon the number of possible positions of bolt holes in the flange members 152 relative to each other.

Spoil Removal Means

The spoil removal means of the embodiment illustrated in FIGS. 1–7 is a suction based system and comprises the cylindrical tubular members 42 which are elongated hollow cylindrical structures supported as described above for movement in planes substantially parallel to the laterally directed plane and a suction creating source, here illustrated centerless pumps 40, for creating a suction at the bottom 158 of the tubular members whereby a fluid flow, which includes spoil material from operation of the cutting assembly, is created at the bottom 158 of member 42 and is carried away from the cutting assembly through member 42. The fluid flow created by centerless pumps 40 is discharged, in the illustrated embodiment, through the eductor discharge openings 44 of tubular discharge members 160. The discharge openings can be directed in substantially any convenient direction and are preferably directed away from both the trenching apparatus and the elongated member beneath which the trench is being created at a rearward and lateral corner of the trenching apparatus.

Figure 8:
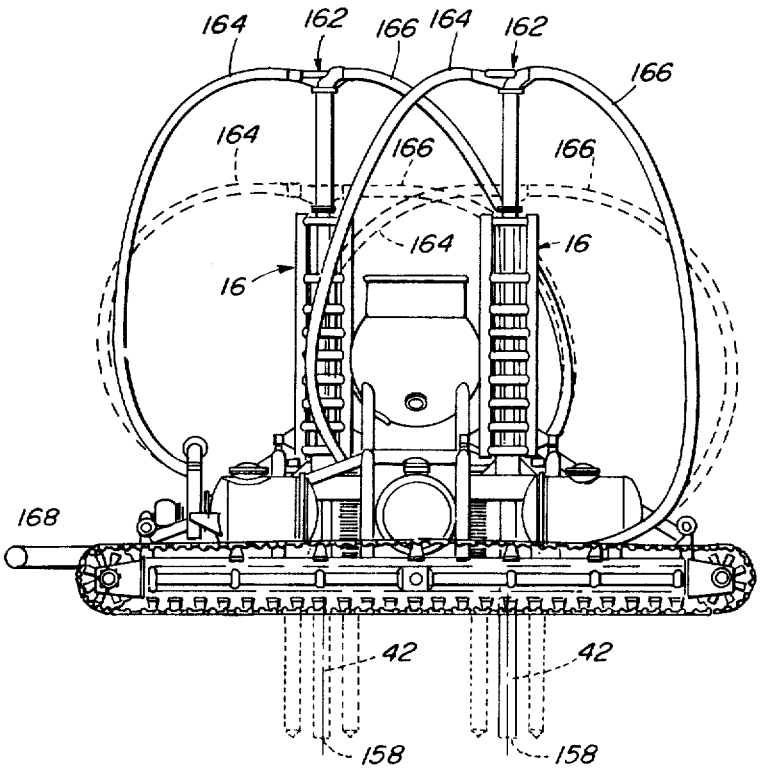
FIG. 8 is a side elevation view of a particular embodiment according to the invention showing an alternate spoil removal system.

Referring to FIG. 8, in an alternate embodiment of the invention, the spoil removal means creates a suction at the bottom 158 of member 42 by what is, in essence, the momentum transfer effect. An eductor type connection device 162 is used in place of the centerless pump. Suction flow into bottom 158 is created by forcing fluid under pressure through flexible lines 164 into the device 162. There results a low-pressure or partial vacuum on the inlet side of device 162 (from tubular member 42), thereby creating a suction at the bottom 158 of member 42. The fluid flow into the eductor 162 continues through flexible discharge conduit 166 which provides a path to discharge openings 168 at a rearward and lateral corner of the trenching apparatus. FIG. 8 also shows the manner in which flexible lines 164 and conduits 166 may vary in shape depending upon the position of member 42. The solid lines indicate the position of the various components when the members 42 are in a raised position, and the phantom lines represent the tubular members 42 in a lowered position, for example during a trenching operation.

General Operation

In the apparatus of FIGS. 1–7, in normal operation, the trenching apparatus 10 is lowered from a surface vessel (not shown) using support lines 202 to an operational relationship wherein the crawler tracks straddle the elongated member 34. (The support lines 202, while shown taut, as they are during the vertical movement of the trenching apparatus, are left loosely hanging during normal operation and do not interfere with movement of the transfer module 66. As noted above, an umbilical tower can be used.) The cutting assemblies 14 can then be lowered into or can trench into a position wherein each preferably has the bottom portion of at least one cutting tool beneath the elongated member (FIG. 10).

Figure 3:
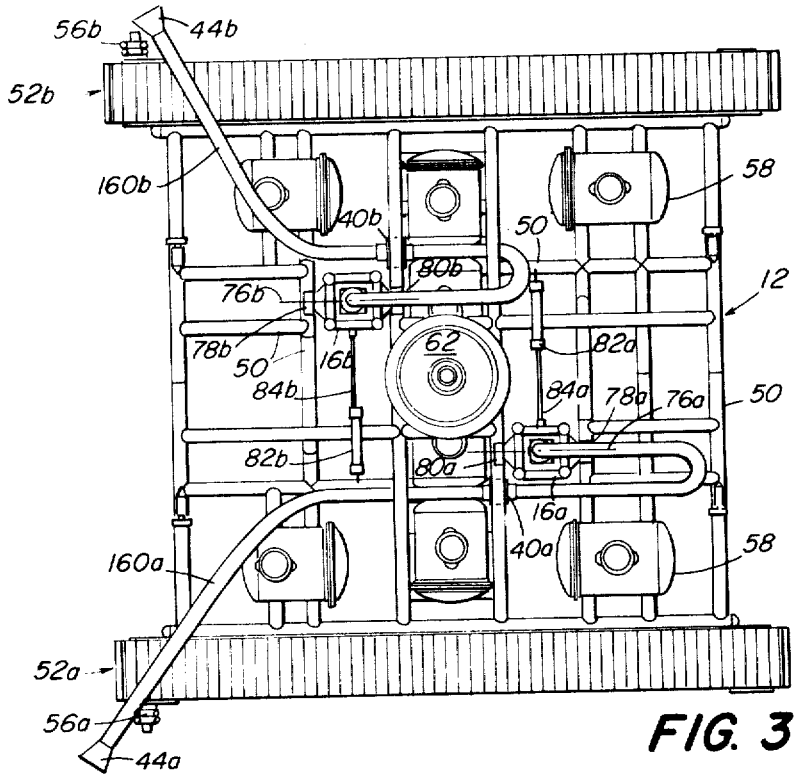
FIG. 3 is a top plane view of the apparatus of FIGS. 1 and 2.
Figure 4:
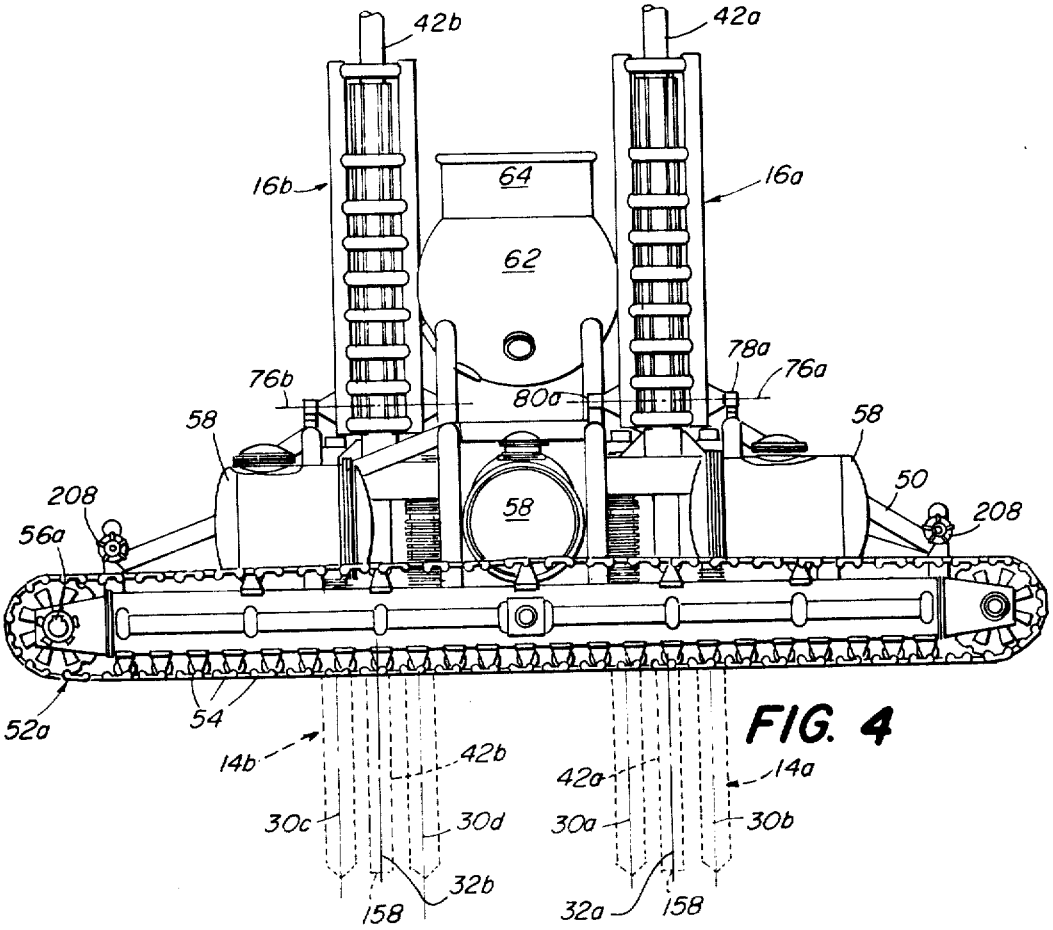
FIG. 4 is a side elevation view of the apparatus of FIGS. 1 and 2.

As noted above, the cutting assemblies are offset both longitudinally and laterally of the center of apparatus 10 (FIGS. 1-3). Each cutting assembly may be adjusted independently of the other to, within the mechanical limits of the assembly, any desired cutting swath, cutting depth, and angle of cut. The cutting swath is adjusted, as noted above, by rotating the cutting assembly about its longitudinal axis (relative to telescoping member 100) thereby changing the angle or orientation of the cutting plane relative to the longitudinal axis of the trenching apparatus. (While in the illustrated embodiment this is a manual operation whereby flanges 152 are rotated relative to one another, in other embodiments of the invention, rotation may be effected dynamically from a remote location.) The angle of cut, that is, the angle of the cutting assembly longitudinal axis relative to the horizontal plane, is adjusted by actuating hydraulic cylinder 82 and thereby driving extending rod 84 to pivot the cutting assembly 16 about pivot axis 76. The cutting depth is adjusted by actuation of hydraulically controlled cylinder 120 thereby moving the associated piston rod 122 to vary the position of the telescoping cylinder relative to the translationally fixed portion of the cutting assembly support means 16, for example tubular members 96, 98.

Figure 9:
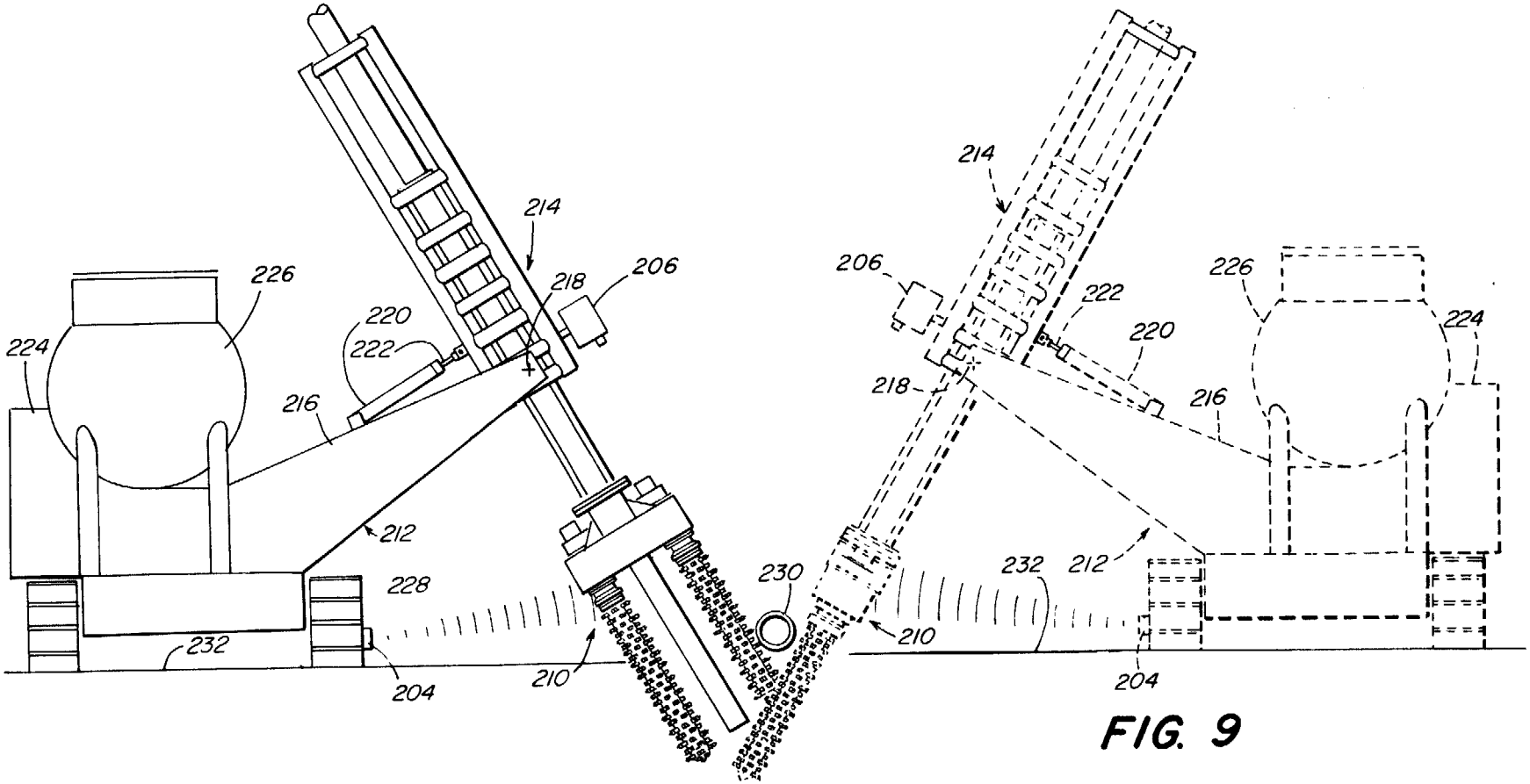
FIG. 9 is a schematic representation of an alternate apparatus and method according to the invention for trenching beneath an elongated member.

In the illustrated apparatus 10, the operator housed in control module 62 has substantially complete control over movement of the apparatus. In order to properly track the elongated member, tracking means, not shown but well known in the art, are used to maintain a specific known operational relationship between the movement of the trenching apparatus 10 and the elongated member. This is true whether the apparatus straddles the elongated member or is off to one side (FIG. 9). Preferably, the operator has available, as the primary tracking system, at least one and preferably a plurality of sensing devices to independently measure the relationship of the apparatus to the elongated member. To that end, a remotely operated sonar 204 and television 206 equipment (FIGS. 9 and 10) may be installed at convenient locations on the apparatus to monitor, both visually and electronically, the operation of the apparatus. An example of another suitable tracking means, which in the illustrated embodiment would be a secondary tracking system, is described in Perot, Jr., U.S. Pat. No. 3,751,927, issued Aug. 14, 1973, whose disclosure is incorporated herein by reference. Using the Perot, Jr. tracking system, positional movement of the apparatus may be substantially controlled by an automatic system; and as a result, the operator's duties would then normally be supervisory only.

In addition to the equipment thus far described, frame 12 may further support hydraulically or electrically operated thrusters 208 which are provided primarily to provide some maneuverability to the apparatus as it is being lowered to the sea bottom. The thrusters may also be used to offset small translational or rotational forces affecting operation of the apparatus, for example slowly moving ocean currents. The thrusters may be operated either under manual control by the operator or under automatic control by a tracking system which maintains the apparatus in alignment with the elongated member.

An Alternate Embodiment of the Trenching Method and Apparatus

The trenching apparatus of the preferred embodiment may be modified to include a greater or fewer number of cutting assemblies than the two longitudinally and laterally offset assemblies of FIGS. 1-8. In particular, referring to FIG. 9, in an alternate particular embodiment of the invention, one cutting assembly 210 is provided, and the trenching apparatus 212, thus configured, may operate as follows. The single cutting assembly 210 is supported for movement in a laterally directed plane and extends away from the path of travel of trenching apparatus 212. The cutting assembly 210 is supported by a cutting assembly support means 214. Support means 214 pivots on an extended portion of the frame member, support arm 216, around a pivot line 218 which extends parallel to the longitudinal axis of the trenching apparatus. The cutting assembly support means is controlled in its pivotal movement around pivot line 218 by a hydraulically actuated and controlled cylinder 220 having an extending piston rod 222.

The support means and cutting assembly extend to one side only of apparatus 212 and create an asymmetry in weight distribution. Hence a counterweight 224 is provided on the other side of apparatus 212 and the counterweight extends outward over the other side of the apparatus to provide a balanced and stable operating system. Under the control and guidance of an operator in a single atmosphere control module 226, and using various measurement and sensory devices such as sonar range measuring device 204, and a television camera system 206 mounted for example on support means 214, the apparatus cuts a trench beneath an elongated member 230 from one side of the member. The spoil and debris created during the cutting or trenching operation are removed from the trench either simultaneously with the trenching step or in a separate pass through a spoil removal system which is preferably identical to that described in connection with FIGS. 1-7. After a complete "pass" has been made, that is, including the trenching and subsequent or simultaneous spoil removal steps, the trenching apparatus 212 may take another pass, if necessary, from the other side of the elongated member 230 to complete the trenching operation. Alternatively, two apparatus can be deployed, one on each side of the elongated member, for simultaneously trenching from both sides of the member.

The steps of the second pass are the same as the steps of the first pass. Thus, spoil and debris may be removed simultaneously with or subsequent to the trenching or cutting step. However, during the second pass, the cutting swath or width may be the same as or different than the cutting swath during the first pass. Similarly, the cutting depth during the second pass may be the same as, deeper, or shallower than the cutting depth during the first pass. In the illustrated embodiment, where the solid portion of the figure indicates the first pass and the phantom portion, the second pass, the cutting swath has been reduced on the second pass and the depth of the cutters has been increased. In practice, as the second trenching operation proceeds, the elongated member 230 will fall into the resulting trench and rest beneath the bottom surface 232 of the body of water.

SUMMARY OF THE ADVANTAGES OF THE INVENTION AND NON-OBVIOUSNESS

The invention advantageously provides a unique and highly effective approach to the use of mechanical cutting apparatus for deep water applications. Also, the invention can be used advantageously in shallow water applications.

The invention advantageously provides a pair of offset mechanical cutting devices which can be easily maneuvered to a position beneath an elongated member wherein the mechanical cutters provide a significantly high rate of forward progress. The cutting assemblies are advantageously independently positionable and provide a maximum flexibility and maneuverability for the assembly. The cutting devices can be advantageously mounted together on a self-propelled unit, offset both laterally and longitudinally from the center of the unit, to provide two separate maneuverable cutting swaths, each of which can be adjusted to a preselected width.

The flexibility of the method of the invention is evidenced by an alternate embodiment of the invention which has only one cutting assembly and makes two or more passes along the elongated member, one on each side of the member, in order to provide the two trenching operations necessary to bury the member. In this embodiment, the apparatus is advantageously removed somewhat from the immediate vicinity of the elongated member.

In a preferred embodiment of the apparatus according to the invention, there is advantageously provided a pressure stabilized control module whereby an operator may be stationed to control or supervise the operation of the trenching apparatus.

Various features of the apparatus disclosed herein are not new. Thus, a self-propelled apparatus for burying elongated members is not new. Nor is it new to provide a burying apparatus with a laterally pivotable rotary cutter in combination with an eductor type spoil removal system. An example of such an apparatus is DeVries, U.S. Pat. No. 3,583,170, issued June 8, 1971.

Similarly, apparatus wherein the individual cutting tools can be characterized by cylinders supporting circumferentially mounted cutter teeth is disclosed, for example, in FIG. 8 of Breston et al, U.S. Pat. No. 3,670,514, issued June 20, 1972. (For a related cutting system see Martin, U.S. Pat. No. 3,429,132, issued Feb. 25, 1969. )

Also, various apparatus have been disclosed which have means for varying the cutting depth of the soil removal elements. For example, Tittle, U.S. Pat. No. 3,338,059, issued Aug. 29, 1967, Perot, Jr., U.S. Pat. No. 3,751,927, issued Aug. 14, 1973, and Good et al, U.S. Pat. No. 3,786,642, issued Jan. 22, 1974, all disclose embodiments wherein the cutting members are vertically adjustable. They do not however contemplate the continuously operable telescoping system claimed herein.

Other related references include Lynch, U.S. Pat. No. 3,732,700, issued May 15, 1973, which has a single, off-center mounted, rotary cutter carried by a self-propelled sled body; and Lecomte, U.S. Pat. No. 3,978,679, issued Sept. 7, 1976, which describes a burying apparatus having a single mechanical cutting tool which is laterally directed to a position beneath the elongated member, the apparatus being positioned to one side of the elongated member and having a releasable command sphere.

These references however simply do not describe, disclose, or suggest the invention claimed herein. Thus, the references totally lack disclosure regarding a self-propelled burying apparatus having two cutting tool axes which define the rotatable cutting plane and means to vary the width of the cut as described and claimed herein; a burying apparatus further incorporating the telescoping apparatus of the present invention or the bifurcated support arm of the present invention to provide, in part, the variable width cutting capability; or an apparatus having at least two cutting assemblies offset from the center of the apparatus both longitudinally and laterally. Not only are these claimed features not suggested or shown in the prior art but they provide a burying apparatus having uniquely advantageous cutting abilities beyond that previously known.

Other embodiments of the invention, including additions, subtractions, deletions, or other modifications of the disclosed preferred particular embodiments will be obvious to those skilled in the art, and are within the scope of the following claims.

What is claimed is:

1. Apparatus for trenching on the bottom of a body of water comprising a movable frame member, at least one cutting assembly, assembly support means connected to said frame member for supporting each cutting assembly and for moving each cutting assembly at least in a laterally directed plane substantially normal to a longitudinal axis of said frame member, each said cutting assembly comprising at least two actuatable cutting tools, each tool having a mechanical cutting means secured thereto for cutting movement, and drive means actuatable for driving, relative to a cutting tool axis, said cutting means in said cutting movement, said cutting tool axes for each assembly being substantially aligned in an assembly cutting plane, tool support means for supporting each of said cutting tools in a downwardly extending direction for cutting movement about their respective tool axes, said tool support means being connected to and movable by said assembly support means, means for rotating said tool support means and said assembly cutting plane about an assembly longitudinal axis, for varying the cutting width of said cutting assembly, said assembly axis being substantially parallel to both said assembly cutting plane and said laterally directed plane, and spoil removal means, supported in a proximate relation to each said cutting assembly, for removing spoil produced by operation of each said cutting assembly.

2. The trenching apparatus of claim 1 wherein there are two cutting assemblies, a first forward cutting assembly and a second rearward cutting assembly, said assemblies having, respectively, first and second laterally directed planes, said planes being spaced apart along the longitudinal axis of said frame.

3. The trenching apparatus of claim 1 further comprising remote sensing equipment for allowing operation and movement of said apparatus from a remote location.

4. The trenching apparatus of claim 1 wherein there is one cutting assembly and further comprising a sonar system for determining a distance between the apparatus and an elongated member.

5. The trenching apparatus of claim 1 wherein said assembly support means comprises at least one cutting depth control assembly for varying the position of an associated cutting assembly along the cutting assembly longitudinal axis, and at least one cutting angle control assembly for varying the angular orientation of the longitudinal axis of the associated cutting assembly in said laterally directed plane.

6. The trenching apparatus of claim 5 wherein each said cutting angle control assembly comprises a hydraulically controlled piston and cylinder assembly connected in a non-interfering configuration between said frame and a corresponding cutting assembly support means for pivotally rotating said cutting assembly in said laterally directed plane.

7. The trenching apparatus of claim 1 wherein said spoil removal means comprises a suction means for each cutting assembly, each said suction means having an elongated hollow cylindrical structure supported for movement in a plane substantially parallel to said laterally directed plane, said structure having a bottom end independently positionable relative to the associated cutting assembly and positionable in a proximate relation to the bottom of said associated cutting assembly, and a suction creating source for creating a suction at the bottom of said cylindrical structure whereby a fluid flow, which includes spoil material from the operation of the cutting assembly, can be created at the bottom of said structure, and discharge means connected to said cylindrical structure for receiving said fluid flow and discharging it away from said cutting assembly.

8. The trenching apparatus of claim 7 wherein said suction creating source is a centerless pump.

9. The trenching apparatus of claim 7 comprising at least one telescoping support assembly for varying the position of an associated cutting assembly along the cutting assembly longitudinal axis, and wherein each cylindrical structure is coaxial with and has a portion mounted for movement within an associated telescoping support assembly for movement independent of said telescoping support and parallel to said cutting assembly longitudinal axis.

10. The trenching apparatus of claim 7 wherein said suction creating source is a water eductor.

11. The trenching apparatus of claim 1 further comprising a pressure stabilized control chamber secured to said frame member for housing an operator to control operation of said apparatus, and said chamber having a transfer module connection for releasably coupling to a transfer module for effecting movement of personnel between said chamber and said module.

12. The trenching apparatus of claim 11 wherein said control chamber further comprises a winch down system for controlling the vertical distance between said control chamber and said transfer module.

13. The trenching apparatus of claim 1 further comprising self-propelling means secured to said frame for moving said frame along said water bottom.

14. The trenching apparatus of claim 13 wherein said self-propelling means comprises at least two crawlers, each consisting of an endless chain of linked tracks, and a power drive means for driving said crawlers.

15. Apparatus for trenching on the bottom of a body of water comprising a movable frame member, at least one cutting assembly, assembly support means connected to the frame member for supporting each cutting assembly and for moving each cutting assembly at least in a laterally directed plane substantially normal to a longitudinal axis of the frame member, each said cutting assembly comprising at least two rotatable cutting tools, each tool having a mechanical cutting means secured thereto for rotational movement, and drive means actuatable for rotating the cutting means in said rotational movement relative to a cutting tool rotation axis, said cutting tool rotation axes for each assembly being substantially aligned in an assembly cutting plane, tool support means for supporting each of the cutting tools in a downwardly extending direction for axial rotation about their respective tool rotation axes, said tool support means being connected to and movable by said assembly support means, and means for rotating the tool support means and said assembly cutting plane about an assembly longitudinal axis for varying the cutting width of said cutting assembly, said assembly axis being substantially parallel to both the assembly cutting plane and the laterally directed plane, and spoil removal means, supported in a proximate relation to each said cutting assembly, for removing spoil produced by operation of each of said cutting assemblies.

16. The trenching apparatus of claim 15 wherein adjacent cutting tools of each cutting assembly rotate in opposite directions about their respective tool rotation axes.

17. An apparatus for trenching the bottom of a body of water comprising a movable frame member, at least one cutting assembly, means secured to said frame member for supporting each cutting assembly and for moving each assembly at least in a laterally directed plane normal to a direction of movement of said frame, and each cutting assembly comprising a rotatable bifurcated cutting tool support arm, said bifurcated cutting tool support arm supporting two generally upright, downwardly directed, rotatable cutting tools, and means actuatable to rotate said tools about respective tool rotating axes.

18. The trenching apparatus of claim 17 wherein each cutting assembly further comprises means for rotating said bifurcated arm about a longitudinal axis of said cutting assembly, thereby rotatably positioning said rotatable cutting tools, as a unit, about said assembly axis and varying the cutting width of said assembly.

19. The trenching apparatus of claim 18 further comprising means for selectively translating each said cutting assembly in a direction parallel to its longitudinal axis, whereby the cutting depth is vertically adjustable.

20. The trenching apparatus of claim 17 wherein there are two cutting assemblies, and wherein said supporting and moving means comprises means for offset mounting said cutting assemblies in a spaced apart relationship both laterally and longitudinally with respect to the center of said frame member, and means for independently adjusting each cutting assembly according to the conditions under which the apparatus is operating.

21. The trenching apparatus of claim 17 wherein said cutting assembly support means comprises for each cutting assembly an extendable support structure, connected to and supporting said cutting assembly, a longitudinally extending connecting means defining a pivot axis parallel to the longitudinal axis of said frame member for supporting the cutting assembly and said extendable support structure for pivotal movement of about said pivot axis, and means connected between the extendable support structure and the frame member for selectively pivoting said cutting assembly about said pivot axis.

22. A method for trenching beneath an elongated member lying on the bottom of a body of water comprising the steps of trenching from one side only of and to a position extending beneath said elongated member and removing the spoil resulting therefrom to form a first trench extending to one side of said member, and thereafter trenching from the other side only of and to a position extending beneath said elongated member and removing the spoil created during said second trenching step to form a second trench, said second trench extending into said first trench, said two trenching steps occurring successively, whereby the elongated member falls into the resulting first and second trenches.

23. The method of claim 22 wherein said removing steps take place simultaneously with said respective trenching steps.

24. The method of claim 22 wherein said removing steps take place sequentially after said respective trenching steps.

25. The method of claim 22 further comprising the step of providing a trenching apparatus having cutting assemblies offset longitudinally along and laterally on either side of a center line of the apparatus to successively trench beneath said elongated member.

26. A method for trenching beneath an elongated member lying on the bottom of a body of water comprising the steps of trenching from one side of and to a position extending beneath said elongated member and removing the spoil resulting therefrom to form a first trench, trenching from the other side of and to a position extending beneath said elongated member and removing the spoil created during said second trenching step to form a second trench, said second trench extending into said first trench, said two trenching steps occurring successively, whereby the elongated member falls into the resulting first and second trenches, and providing a mechanical cutting assembly for said trenching steps, said assembly having a pair of rotatable cutters mounted on a rotatable bifurcated support arm.

* * * * *